US012083391B2

(12) United States Patent
Goji et al.

(10) Patent No.: US 12,083,391 B2
(45) Date of Patent: Sep. 10, 2024

(54) GOLF BALL

(71) Applicant: Sumitomo Rubber Industries, Ltd., Kobe (JP)

(72) Inventors: Sho Goji, Kobe (JP); Kazuyoshi Shiga, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 50 days.

(21) Appl. No.: 18/109,703

(22) Filed: Feb. 14, 2023

(65) Prior Publication Data

US 2023/0293949 A1 Sep. 21, 2023

(30) Foreign Application Priority Data

Feb. 25, 2022 (JP) ..... 2022-028072

(51) Int. Cl.
*A63B 37/06* (2006.01)
*A63B 37/00* (2006.01)
*A63B 47/00* (2006.01)

(52) U.S. Cl.
CPC ..... *A63B 37/0062* (2013.01); *A63B 37/0045* (2013.01); *A63B 37/0064* (2013.01);
(Continued)

(58) Field of Classification Search
CPC ..... A63B 37/0062; A63B 37/0063
See application file for complete search history.

(56) References Cited

U.S. PATENT DOCUMENTS

2003/0130065 A1 7/2003 Watanabe
2013/0005506 A1* 1/2013 Isogawa ..... C08K 5/098 473/372

(Continued)

FOREIGN PATENT DOCUMENTS

JP 2003-190331 A 7/2003
JP 2016-123634 A 7/2016

*Primary Examiner* — Raeann Gorden
(74) *Attorney, Agent, or Firm* — Birch, Stewart, Kolasch & Birch, LLP

(57) ABSTRACT

An object of the present disclosure is to provide a golf ball having an increased spin rate when being hit with an 8-iron while suppressing rise in a spin rate when being hit with a driver. The present disclosure provides a golf ball comprising a spherical core having an inner core and an outer core, and a cover positioned outside the spherical core, wherein A×a is 12,200 or less and B×b is 20,400 or more, where "a" represents an average hardness (Shore C) of a hardness (H2.5) at a point of 2.5 mm from a center of the spherical core and a hardness (H5) at a point of 5 mm from the center of the spherical core, "b" represents an average hardness (Shore C) of a hardness (H7.5) at a point of 7.5 mm from the center of the spherical core and a hardness (H9) at a point of 9 mm from the center of the spherical core, "A" represents an impulse difference (kN·μs) between a back spin impulse and a top spin impulse measured using a contact force tester under a condition corresponding to a condition when the golf ball is hit with a driver, and "B" represents an impulse difference (kN·μs) between a back spin impulse and a top spin impulse measured using a contact force tester under a condition corresponding to a condition when the golf ball is hit with an 8-iron.

19 Claims, 6 Drawing Sheets

(52) U.S. Cl.
CPC ..... *A63B 37/0075* (2013.01); *A63B 37/0076* (2013.01); *A63B 37/0096* (2013.01); *A63B 47/008* (2013.01)

(56) References Cited

U.S. PATENT DOCUMENTS

2013/0316851 A1* 11/2013 Sajima ..... A63B 37/0039
473/373
2016/0184657 A1 6/2016 Tachibana et al.

* cited by examiner

GOLF BALL

FIELD OF THE INVENTION

The present disclosure relates to a golf ball comprising a multi-layered core.

DESCRIPTION OF THE RELATED ART

To achieve a great flight distance on driver shots, a golf ball comprising a dual layered core with a distinctive hardness distribution has been proposed.

For example, JP 2016-123634 A discloses a golf ball comprising a spherical core and a cover positioned outside the spherical core, wherein the spherical core includes an inner layer and an outer layer, a difference ($H_{x+1}-H_{x-1}$) between a hardness ($H_{x+1}$) at a point outwardly away in a radial direction from a boundary between the inner layer and the outer layer of the spherical core by 1 mm and a hardness ($H_{x-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 70 in Shore C hardness, an angle $\alpha$ of a hardness gradient of the inner layer is 0° or more, and a difference ($\alpha-\beta$) between the angle $\alpha$ and an angle $\beta$ of a hardness gradient of the outer layer is 0° or more.

JP 2003-190331 A discloses a three-piece solid golf ball comprising a core inner layer formed from a rubber composition, a core outer layer enclosing the core inner layer and formed from another rubber composition, and a cover enclosing the core outer layer and formed mainly from a polyurethane elastomer, wherein said core inner layer has a JIS-C hardness of 50 to 85, said core outer layer has a JIS-C hardness of 70 to 90, a difference ($H_0-H_1$) between a surface JIS-C hardness Ho of said core outer layer and a center JIS-C hardness $H_1$ of said core inner layer is 20 to 30, and said cover has a Shore D hardness of 46 to 55 and a thickness of 1.1 to 2.1 mm.

SUMMARY OF THE INVENTION

Professional golfers and skilled amateurs demand a golf ball having improved controllability when being hit with an 8-iron while maintaining a great flight distance on driver shots. If the spin rate of the golf ball on driver shots is decreased to increase the flight distance on driver shots, the spin rate of the golf ball when being hit with an 8-iron also decreases, and thus the controllability on 8-iron shots decreases. In addition, if the spin rate of the golf ball when being hit with an 8-iron is increased, the spin rate of the golf ball on driver shots also increases, and thus the flight distance on driver shots decreases. Thus, it is difficult to improve the controllability on 8-iron shots while maintaining the flight distance on driver shots.

The present disclosure has been made in view of the above circumstances, and an object of the present disclosure is to provide a golf ball having an increased spin rate on 8-iron shots while suppressing increase in a spin rate on driver shots.

The present disclosure that has solved the above problem provides a golf ball comprising a spherical core having an inner core and an outer core, and a cover positioned outside the spherical core, wherein A×a is 12,200 or less and B×b is 20,400 or more, where "a" represents an average hardness (Shore C) of a hardness (H2.5) at a point of 2.5 mm from a center of the spherical core and a hardness (H5) at a point of 5 mm from the center of the spherical core, "b" represents an average hardness (Shore C) of a hardness (H7.5) at a point of 7.5 mm from the center of the spherical core and a hardness (H9) at a point of 9 mm from the center of the spherical core, "A" represents an impulse difference (kN·μs) between a back spin impulse and a top spin impulse measured using a contact force tester under a condition corresponding to a condition when the golf ball is hit with a driver, and "B" represents an impulse difference (kN·μs) between a back spin impulse and a top spin impulse measured using a contact force tester under a condition corresponding to a condition when the golf ball is hit with an 8-iron.

According to the present disclosure, a golf ball having an increased spin rate on 8-iron shots while suppressing increase in a spin rate on driver shots is obtained. The golf ball according to the present disclosure has improved controllability on 8-iron shots while maintaining the flight distance on driver shots.

DESCRIPTION OF THE PREFERRED EMBODIMENT

Figure 1:
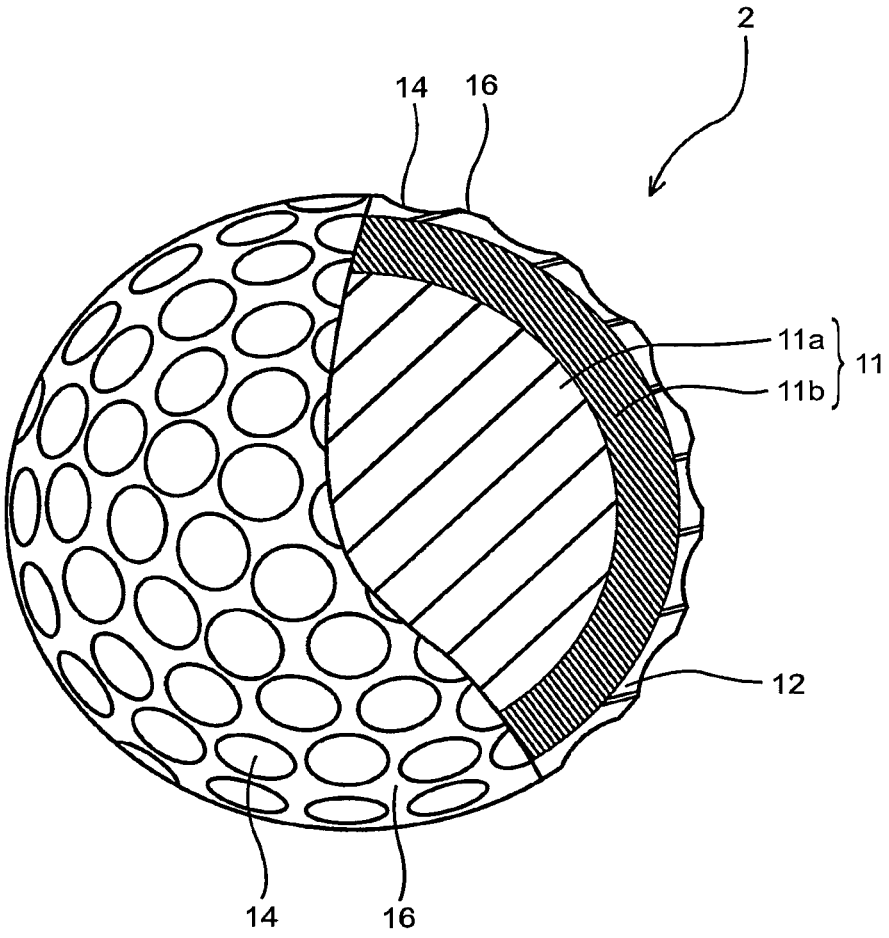
FIG. 1 is a partially cutaway cross-sectional view of a golf ball according to one embodiment of the present disclosure.

The present disclosure provides a golf ball comprising a spherical core having an inner core and an outer core, and a cover positioned outside the spherical core, wherein A×a is 12,200 or less and B×b is 20,400 or more, where "a" represents an average hardness (Shore C) of a hardness (H2.5) at a point of 2.5 mm from a center of the spherical core and a hardness (H5) at a point of 5 mm from the center of the spherical core, "b" represents an average hardness (Shore C) of a hardness (H7.5) at a point of 7.5 mm from the center of the spherical core and a hardness (H9) at a point of 9 mm from the center of the spherical core, "A" represents an impulse difference (kN·μs) between a back spin impulse and a top spin impulse measured using a contact force tester under a condition corresponding to a condition when the golf ball is hit with a driver, and "B" represents an impulse difference (kN·μs) between a back spin impulse and a top spin impulse measured using a contact force tester under a condition corresponding to a condition when the golf ball is hit with an 8-iron.

The golf ball according to the present disclosure comprises a spherical core having an inner core and an outer core, and a cover positioned outside the spherical core. The spherical core preferably has a spherical inner core and an outer core covering the spherical inner core.

[Average Hardness "a"]

In the golf ball according to the present disclosure, the average hardness "a" is an average hardness (Shore C) of a hardness (H2.5) at a point of 2.5 mm from the center of the spherical core and a hardness (H5) at a point of 5 mm from the center of the spherical core. The average hardness "a" is preferably 70 or less, more preferably 69 or less, and even more preferably 68 or less in Shore C hardness. If the average hardness a is 70 or less in Shore C hardness, the spin rate of the golf ball when being hit with a driver can be decreased while the spin rate of the golf ball when being hit with an 8-iron is maintained. In addition, the lower limit of the average hardness "a" is not particularly limited, and is preferably 50, more preferably 52, and even more preferably 54 in Shore C hardness.

[Average Hardness "b"]

In the golf ball according to the present disclosure, the average hardness "b" is an average hardness (Shore C) of a hardness (H7.5) at a point of 7.5 mm from the center of the spherical core and a hardness (H9) at a point of 9 mm from the center of the spherical core. The average hardness "b" is preferably 70 or more, more preferably 72 or more, and even more preferably 74 or more in Shore C hardness. If the average hardness "b" is 70 or more in Shore C hardness, the spin rate of the golf ball when being hit with an 8-iron can be increased. It is noted that the spin rate on driver shots also increases when the average hardness "b" is 70 or more in Shore C hardness, but the increase of the spin rate on driver shots is suppressed when the average hardness "a" is 70 or less in Shore C hardness. In addition, the upper limit of the average hardness "b" is not particularly limited, and is preferably 90, more preferably 88, and even more preferably 86 in Shore C hardness.

[Hardness Difference (b-a)]

The hardness difference (b-a) between the average hardness "b" and the average hardness "a" is preferably 5 or more, more preferably 7 or more, and even more preferably 9 or more in Shore C hardness, and is preferably 40 or less, more preferably 35 or less, and even more preferably 30 or less in Shore C hardness. If the hardness difference (b-a) falls within the above range, the spin rate on 8-iron shots can be increased while the spin rate on driver shots is maintained.

[Hardness Distribution of Core]

(Hardness Ho)

The center hardness (Ho) of the spherical core is preferably 50 or more, more preferably 55 or more, and even more preferably 60 or more in Shore C hardness, and is preferably 75 or less, more preferably 70 or less, and even more preferably 65 or less in Shore C hardness. If the center hardness (Ho) of the spherical core falls within the above range, the resilience is better.

(Hardness H2.5)

The hardness (H2.5) at the point of 2.5 mm from the center of the spherical core is preferably 70 or less, more preferably 68 or less, and even more preferably 65 or less in Shore C hardness, and is preferably 55 or more, more preferably 58 or more, and even more preferably 60 or more in Shore C hardness.

(Hardness H5)

The hardness (H5) at the point of 5 mm from the center of the spherical core is preferably 75 or less, more preferably 72 or less, and even more preferably 70 or less in Shore C hardness, and is preferably 60 or more, more preferably 62 or more, and even more preferably 68 or more in Shore C hardness.

(Hardness H7.5)

The hardness (H7.5) at the point of 7.5 mm from the center of the spherical core is preferably 65 or more, more preferably 70 or more, and even more preferably 75 or more in Shore C hardness, and is preferably 90 or less, more preferably 85 or less, and even more preferably 80 or less in Shore C hardness.

(Hardness H9)

The hardness (H9) at the point of 9 mm from the center of the spherical core is preferably 70 or more, more preferably 75 or more, and even more preferably 80 or more in Shore C hardness, and is preferably 95 or less, more preferably 90 or less, and even more preferably 85 or less in Shore C hardness.

(Hardness Difference (H9−Ho))

The hardness difference (H9−Ho) between the hardness (H9) at the point of 9 mm from the center of the spherical core and the center hardness (Ho) of the spherical core is preferably 5 or more, more preferably 8 or more, and even more preferably 10 or more in Shore C hardness. If the hardness difference (H9−Ho) falls within the above range, the spin rate on 8-iron shots can be increased while the spin rate on driver shots is maintained.

(Hardness H11)

The hardness (H11) at the point of 11 mm from the center of the spherical core is preferably 65 or more, more preferably 70 or more, and even more preferably 75 or more in Shore C hardness, and is preferably 95 or less, more preferably 90 or less, and even more preferably 85 or less in Shore C hardness.

(Hardness H12.5)

The hardness (H12.5) at the point of 12.5 mm from the center of the spherical core is preferably 65 or more, more preferably 70 or more, and even more preferably 75 or more in Shore C hardness, and is preferably 95 or less, more preferably 90 or less, and even more preferably 85 or less in Shore C hardness.

(Hardness H15)

The hardness (H15) at the point of 15 mm from the center of the spherical core is preferably 65 or more, more preferably 70 or more, and even more preferably 75 or more in Shore C hardness, and is preferably 95 or less, more preferably 90 or less, and even more preferably 85 or less in Shore C hardness.

The above Ho, H2.5, H5, H7.5, H9, H11, H12.5 and H15 are hardnesses measured on a cross-section surface obtained by cutting the spherical core into two equal parts along a plane passing through the central point of the spherical core.

(Hardness Hs)

The surface hardness (Hs) of the spherical core is preferably 70 or more, more preferably 75 or more, and even more preferably 80 or more in Shore C hardness, and is preferably 100 or less, more preferably 95 or less, and even more preferably 90 or less in Shore C hardness. If the surface hardness (Hs) of the spherical core falls within the above range, the resilience is better.

(Hardness Difference (Hs−H11))

The hardness difference (Hs−H11) between the surface hardness Hs of the spherical core and the hardness (H11) at the point of 11 mm from the center of the spherical core is preferably 0 or more, more preferably 2 or more, and even more preferably 4 or more in Shore C hardness, and is preferably 20 or less, more preferably 18 or less, and even more preferably 16 or less in Shore C hardness.

(Hardness Difference (Hs−Ho))

The spherical core preferably has an outer-hard and inner-soft hardness distribution. The hardness difference (Hs−Ho) between the surface hardness (Hs) and the center hardness (Ho) of the spherical core is preferably more than 10, more preferably 15 or more, and even more preferably 20 or more in Shore C hardness. In addition, the upper limit of the hardness difference (Hs−Ho) is not particularly limited, and is preferably 35, more preferably 30, and even more preferably 28 in Shore C hardness. If the hardness difference (Hs−Ho) falls with the above range, the increase in the spin rate on driver shots can be prevented.

The diameter of the spherical inner core is preferably 14 mm or more, more preferably 16 mm or more, and is preferably 28 mm or less, more preferably 24 mm or less. If the diameter of the spherical inner core falls within the above range, the spin rates on driver shots and 8-iron shots can be designed without affecting the resilience performance.

The thickness of the outer core is preferably 6 mm or more, more preferably 8 mm or more, and is preferably 13 mm or less, more preferably 12 mm or less. If the thickness of the outer core falls within the above range, a good balance is struck between maintaining the resilience performance and designing the spin performance.

The diameter of the spherical core having the inner core and the outer core is preferably 37 mm or more, more preferably 37.5 mm or more, and even more preferably 38 mm or more, and is preferably 41.5 mm or less, more preferably 41 mm or less, and even more preferably 40.5 mm or less. If the diameter of the spherical core is 37 mm or more, the cover is not excessively thick, and thus the resilience is better. On the other hand, if the diameter of the spherical core is 41.5 mm or less, the cover is not excessively thin, and thus the cover functions better.

[Compression Deformation Amount of Core]

When the spherical core has a diameter in a range of from 34.8 mm to 42.2 mm, preferably in a range of from 37 mm to 41.5 mm, the compression deformation amount (shrinking amount along the compression direction) of the spherical core when applying a load from 98 N as an initial load to 1275 N as a final load to the spherical core is preferably 2.0 mm or more, more preferably 2.1 mm or more, and is preferably 3.5 mm or less, more preferably 3.3 mm or less. If the compression deformation amount of the spherical core falls within the above range, better shot feeling is obtained.

The golf ball according to the present disclosure comprises a cover positioned outside the core. The cover has at least one layer, and may be single layered or multiple-layered. It is noted that in the case that the cover is multiple-layered, a cover layer positioned on the outermost side is sometimes referred to as an outermost cover layer or outer cover layer, and a cover layer located between the spherical core and the cover layer positioned on the outermost side is sometimes referred to as an inner cover layer or intermediate layer.

The thickness of the cover is preferably 4.0 mm or less, more preferably 3.0 mm or less, and even more preferably 2.5 mm or less. If the thickness of the cover is 4.0 mm or less, the obtained golf ball has better resilience or shot feeling. The thickness of the cover is preferably 0.3 mm or more, more preferably 0.5 mm or more, and even more preferably 0.8 mm or more. If the thickness of the cover is less than 0.3 mm, the durability or wear resistance of the cover may be lowered. In the case that the cover is multiple-layered, the total thickness of the multiple-layered cover preferably falls within the above range.

The material hardness (slab hardness) of the outermost cover layer of the golf ball according to the present disclosure is preferably determined in accordance with the desired performance of the golf ball. For example, the material hardness of a composition for forming the outermost cover layer is preferably 10 or more, more preferably 15 or more, and even more preferably 20 or more in Shore D hardness, and is preferably 50 or less, more preferably 45 or less, and even more preferably 40 or less in Shore D hardness. In the case that the cover is multiple-layered, the material hardness of a composition for forming the inner cover layer is preferably 40 or more, more preferably 45 or more, and even more preferably 50 or more in Shore D hardness, and is preferably 75 or less, more preferably 72 or less, and even more preferably 70 or less in Shore D hardness.

[Golf Ball]

The construction of the golf ball according to the present disclosure is not particularly limited, as long as the golf ball comprises a spherical core having an inner core and an outer core, and a cover positioned outside the spherical core. Examples of the golf ball according to the present disclosure include a three-piece golf ball composed of a spherical core having an inner core and an outer core, and a single layered cover positioned outside the spherical core; a four-piece golf ball composed of a spherical core having an inner core and an outer core, and a dual layered cover positioned outside the spherical core; and a multiple-piece golf ball composed of a spherical core having an inner core and an outer core, and a cover positioned outside the spherical core and composed of at least three layers.

FIG. 1 is a partially cutaway cross-sectional view of a golf ball 2 according to one embodiment of the present disclosure. The golf ball 2 comprises a spherical core 11 composed of an inner core 11a and an outer core 11b covering the inner core 11a, and a cover 12 covering the spherical core 11. A plurality of dimples 14 are formed on the surface of the cover 12. Other portions than the dimples 14 on the surface of the golf ball 2 are lands 16. The golf ball 2 is provided with a paint layer and a mark layer on an outer side of the cover 12, but these layers are not depicted.

The golf ball according to the present disclosure preferably has a diameter ranging from 40 mm to 45 mm. In light of satisfying the regulation of US Golf Association (USGA), the diameter is particularly preferably 42.67 mm or more. In light of prevention of air resistance, the diameter is more preferably 44 mm or less, and most preferably 42.80 mm or less. In addition, the golf ball according to the present disclosure preferably has a mass of 40 g or more and 50 g or less. In light of obtaining greater inertia, the mass is more preferably 44 g or more, and most preferably 45.00 g or more. In light of satisfying the regulation of USGA, the mass is most preferably 45.93 g or less.

When the golf ball according to the present disclosure has a diameter in a range of from 40 mm to 45 mm, the compression deformation amount (shrinking amount along the compression direction) of the golf ball when applying a load from an initial load of 98 N to a final load of 1275 N to the golf ball is preferably 2.0 mm or more, more preferably 2.1 mm or more, and is preferably 4.0 mm or less, more preferably 3.0 mm or less.

[Impulse Difference A]

In the present disclosure, the impulse difference A is an impulse difference (back spin impulse−top spin impulse) between a back spin impulse and a top spin impulse measured using a contact force tester under a condition corresponding to a condition when the golf ball is hit with a driver. The impulse difference A is preferably 200 kN·μs or less, more preferably 190 kN·μs or less, and even more preferably 180 kN·μs or less. If the impulse difference A is 200 kN·μs or less, the spin rate of the golf ball when being hit with a driver is further lowered. In addition, the lower limit of the impulse difference A is not particularly limited, and is preferably 90 kN·μs, more preferably 100 kN·μs, and even more preferably 110 kN·μs.

[Impulse Difference B]

In the present disclosure, the impulse difference B is an impulse difference (back spin impulse−top spin impulse) between a back spin impulse and a top spin impulse measured using a contact force tester under a condition corresponding to a condition when the golf ball is hit with an 8-iron. The impulse difference B is preferably 230 kN·μs or more, more preferably 240 kN·μs or more, and even more preferably 250 kN·μs or more. If the impulse difference B is 230 kN·μs or more, the spin rate of the golf ball when being hit with an 8-iron is further increased. In addition, the upper limit of the impulse difference B is not particularly limited, and is preferably 350 kN·μs, more preferably 340 kN·μs, and even more preferably 330 KN·μs.

[Product A×a]

In the present disclosure, the product A×a is a product of the impulse difference A (kN·μs) and the average hardness "a" (Shore C). The product A×a is preferably 12,200 or less, more preferably 12,000 or less, and even more preferably 11,800 or less. If the product A×a is 12,200 or less, the spin rate of the golf ball when being hit with a driver is decreased while the spin rate of the golf ball when being hit with an 8-iron is maintained. In addition, the lower limit of the product A×a is not particularly limited, and is preferably 7,000, more preferably 7,500, and even more preferably 8,000.

[Product B×b]

In the present disclosure, the product B×b is a product of the impulse difference B (kN·μs) and the average hardness "b" (Shore C). The product B×b is preferably 20,400 or more, more preferably 20,600 or more, and even more preferably 20,800 or more. If the product B×b is 20,400 or more, the spin rate of the golf ball when being hit with an 8-iron is increased. It is noted that if the product B×b is 20,400 or more, the spin rate of the golf ball when being hit with a driver also increases, but if the product B×b is 20,400 or more and simultaneously the product A×a is 12,200 or less, the spin rate of the golf ball when being hit with an 8-iron is increased while the spin rate of the golf ball when being hit with a driver is maintained. In addition, the upper limit of the product B×b is not particularly limited, and is preferably 28,000, more preferably 27,500, and even more preferably 27,000.

[Ratio ((B×b)/(A×a))]

The ratio ((B×b)/(A×a)) of (B×b) to (A×a) is preferably 1.80 or more, more preferably 1.82 or more, and even more preferably 1.84 or more. If the ratio ((B×b)/(A×a)) is 1.80 or more, the spin rate on 8-iron shots is further increased while the spin rate on driver shots is maintained. In addition, the upper limit of the ratio ((B×b)/(A×a)) is not particularly limited, and is preferably 2.80, more preferably 2.75, and even more preferably 2.70.

[Ratio (B/A)]

The ratio (B/A) of the impulse difference "B" to the impulse difference "A" is preferably 1.60 or more, more preferably 1.62 or more, and even more preferably 1.64 or more. If the ratio (B/A) is 1.60 or more, the spin rate on 8-iron shots is further increased while the spin rate on driver shots is maintained. In addition, the upper limit of the ratio (B/A) is not particularly limited, and is preferably 2.50, more preferably 2.45, and even more preferably 2.40.

Next, the method for measuring the top spin impulse and back spin impulse of the golf ball in the present disclosure will be explained.

Figure 2:
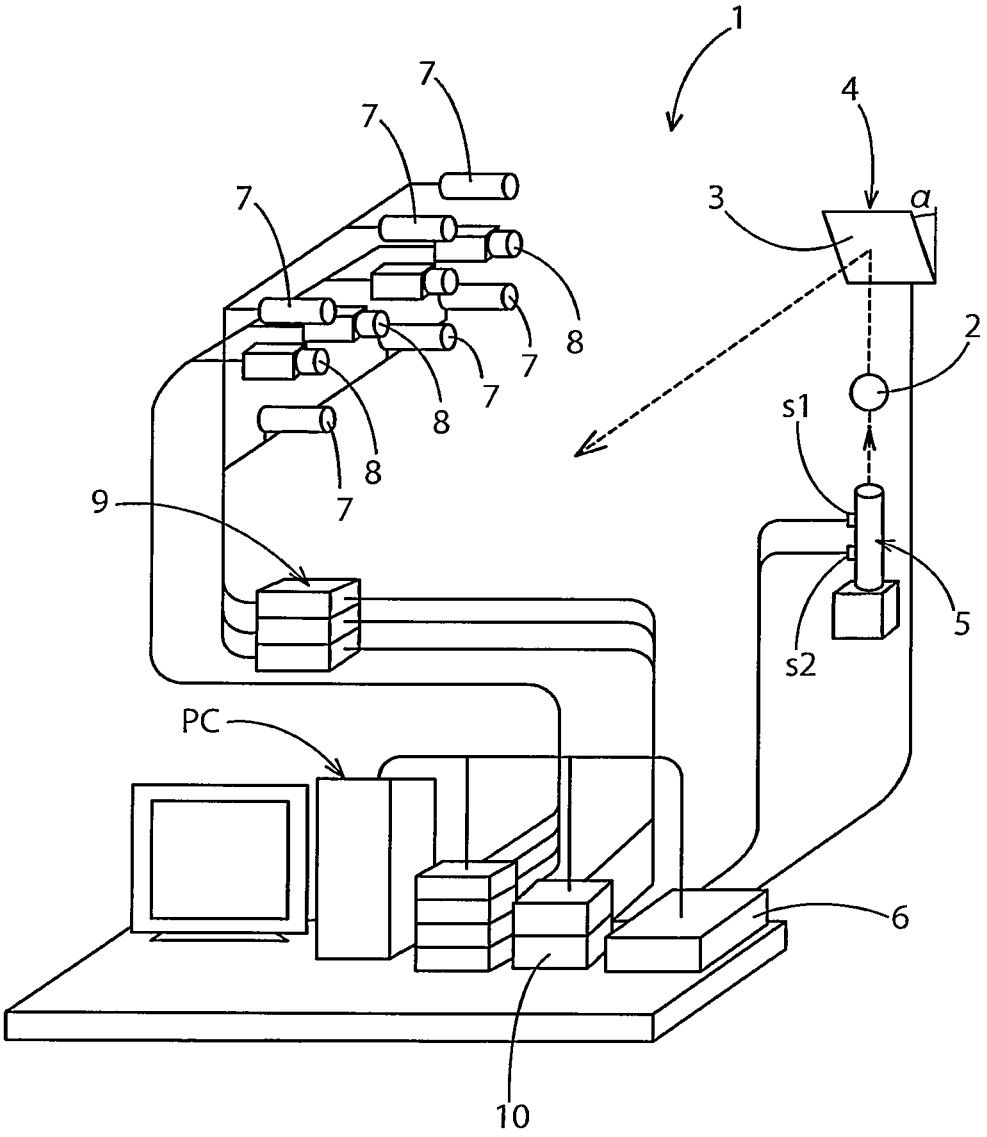
FIG. 2 is a schematic view of a contact force tester used in the present disclosure.
Figure 3:
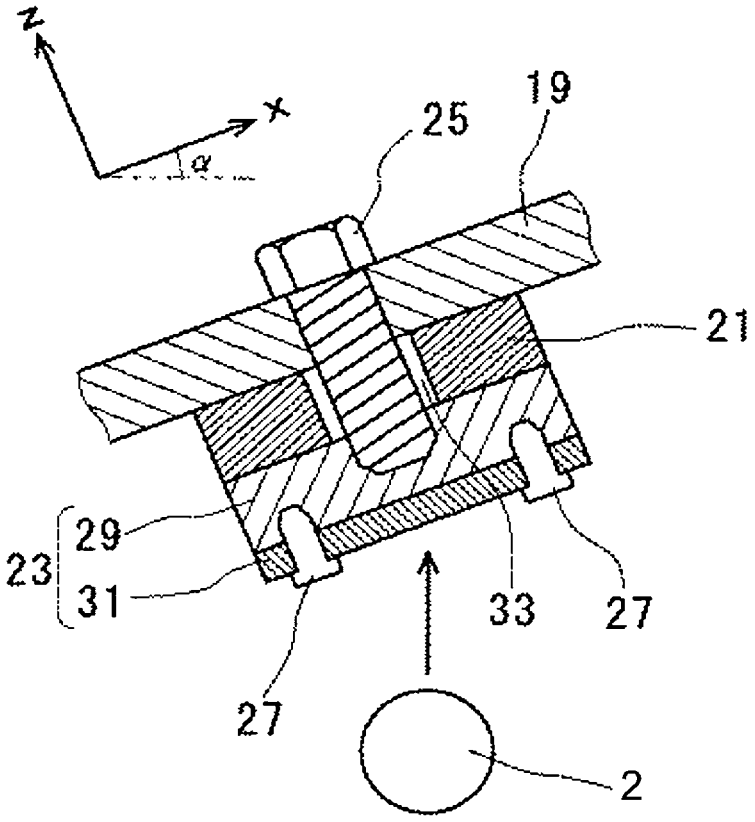
FIG. 3 is a partially enlarged cross-sectional view of a collision part of the contact force tester used in the present disclosure.

The method of calculating the impulse difference in the present disclosure will be explained with reference to FIGS. 2 to 4. FIG. 2 shows a contact force tester for measuring the impulse of the golf ball in the present disclosure. FIG. 3 is an enlarged cross-sectional view of a collision part 4 that the golf ball is allowed to collide with.

The contact force tester 1 makes pseudo conditions of hitting a golf ball with a club face, and enables to measure various forces at that time. The contact force tester 1 includes, for example, a launcher 5 launching a golf ball 2 in a vertically upward direction, and a collision part 4 positioned on an upper side of the launched golf ball 2 and having a striking face 3 that the golf ball 2 collides with.

Since a distance between the launcher 5 and the striking face 3 is relatively short, an initial velocity of the golf ball 2 corresponds to a collision velocity. In addition, this collision velocity corresponds to a head speed of a club head in an actual golf swing. In view of this point, the collision velocity of the golf ball 2 to the striking face 3 may be set, for example, within the range of about 10 m/sec to about 50 m/sec.

The desired value of the initial velocity of the golf ball 2 is set by the volume of a controller 6. In addition, based on a distance between a first sensor S1 and a second sensor S2 provided in the launcher 5, and a time difference between interrupting these sensors, the controller 6 calculates the actually measured value of the initial velocity of the golf ball 2, and outputs the value to a computer device PC.

The contact force tester 1 further includes a strobe device 7 and a high speed type camera device 8 enabling to take a photograph of the collision between the golf ball 2 and the striking face 3 as well as the golf ball 2 rebounding from the striking face 3. The strobe device 7 is connected to a strobe power 9. In addition, the camera device 8 is connected to a camera power 10 via a capacitor box. The imaged data is memorized in the computer device PC. By including these devices, a slipping velocity and a contact area and a launch velocity, a launch angle, a back spin rate of the golf ball at the time of the collision between the golf ball 2 and the striking face 3, which will be explained later, is measured.

FIG. 3 is a partially cross-sectional view showing the collision part 4 of the contact force tester 1. The collision part 4 includes a base plate 19, a load cell 21, a collision plate 23, a main bolt 25, and a small bolt 27. The collision plate 23 is composed of a main body 29 and a cover plate 31. In this FIG. 3, a direction rotated counter-clockwise by $\alpha°$ (degree) to a vertically upward direction is z direction, and a direction rotated counter-clockwise by $\alpha°$ to a horizontally rightward direction is x direction. The x direction and the z direction are perpendicular to each other. The angle $\alpha$ varies depending on the measurement. The base plate 19, the load cell 21 and the collision plate 23 have a determined position to extend along the x direction.

As long as the base plate 19, the main bolt 25 and the small bolt 27 have excellent strength and rigidity, any material may be used, without any limitation, for forming the base plate 19, the main bolt 25 and the small bolt 27. Generally, steel is used. The base plate 19 has a thickness of 5.35 mm. In addition, a model number of the main bolt 25 is M10, and a model number of the small bolt 27 is M3, according to JIS.

As the load cell 21, a 3-component force sensor (model 9067) available from Kistler Instrument Corporation is used. This sensor enables to measure force components in the x direction, y direction (a direction perpendicular to the sheet in FIG. 3) and z direction. The measurement is conducted by connecting a charge amplifier (model 5011B available from Kistler Instrument Corporation, not shown) to the load cell 21. A through-hole 33 through which the main bolt 25 is penetrating is provided at the center of the load cell 21.

The main body 29 of the collision plate 23 is formed from stainless steel (SUS-630). The thickness of the main body 29 is preferably from 10 mm to 20 mm, more preferably 15 mm. In addition, the main body 29 has a same planner shape as the load cell 21, and the planner shape is preferably a square shape having a length ranging from 40 mm to 60 mm on each side, and more preferably a square shape having a length of 56 mm on each side. A front end of the main bolt 25 is screwed into the main body 29, by which the load cell 21 is sandwiched and thus fixed between the base plate 19 and the main body 29.

The cover plate 31 is detachably fixed to the main body 29 with two small bolts 27, 27. The thickness of the cover plate 31 is preferably from 1.0 mm to 5.0 mm, more preferably 2.5 mm. In addition, the cover plate 31 has a same planner shape as the load cell 21, and the planner shape is preferably a square shape having a length ranging from 40 mm to 60 mm on each side, and more preferably a square shape having a length of 56 mm on each side. The cover plate 31 is provided to keep the collision surface of the collision plate 23 a constant level.

Various materials, planner shapes and surface structures may be adopted for the cover plate 31, but the cover plate 31 is preferably formed from the same material as the face of the golf club head which is subject to an analysis. For example, in the present disclosure, when the impulse on driver shots is measured, as the material for forming the cover plate 31, a titanium alloy (6-4 Ti) comprising 6 mass % of aluminum and 4 mass % of vanadium is adopted. In this case, the ten-point average roughness Rz of the cover plate 31 is 13.6 μm±2.0 μm.

In the present disclosure, when measuring the impulse on 8-iron shots, the iron face shape is uniform for the measurement of the spin rate and the measurement of the contact force. As the cover plate 31, a plate prepared by processing the face of the product used for the measurement of the spin rate is preferably adopted.

When measuring the impulse with the contact force tester, the golf ball 2 is launched in a vertically upward direction, and collided with the nearly central position of the collision plate 23. The velocity of the golf ball 2 may be set within the range of about 10 m/sec to about 50 m/sec right before the collision.

The golf ball 2 after the collision rebounds in a lower right direction in FIG. 3. Fn(t) which is a time-series data of the force in the z direction and Ft(t) which is a time-series data of the force in the x direction at the time of the collision are measured with the load cell 21. The measurement is conducted by sampling data per a frequency of 5000000 Hz. The sampled data is smoothened by calculating a moving average of every seven points. From the measured Fn(t), a time T1 is determined. This T1 is a time from the start of the collision till the sign of Fn(t) reaches zero from an initial positive value. In addition, from the measured Ft(t), a time T2 is determined. This T2 is a time from a start of the collision till the sign of Ft(t) turns into a negative value from an initial positive value.

Figure 4:
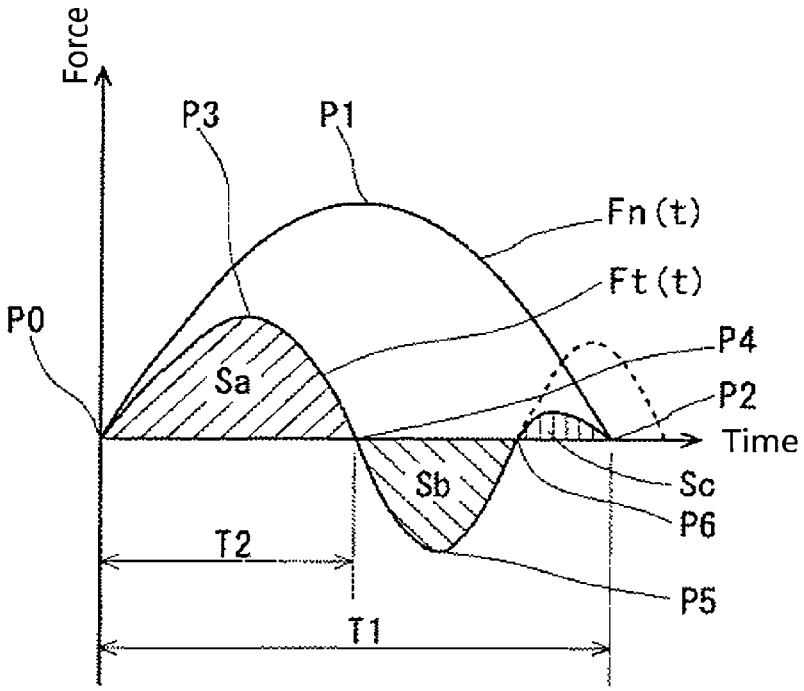
FIG. 4 is a graph showing one example of a time series data of a force measured with the contact force tester.

FIG. 4 is a graph showing one example of Fn(t) and Ft(t) measured with the collision part 4 in FIG. 3. In the graph, an original point P0 is a time point at which the load cell 21 starts sensing the force, and is nearly equivalent to the time point at which the collision plate 23 and the golf ball 2 come into collision with each other. Fn(t) is the force in the z direction, and gradually rises from the point P0 to reach a maximum value at a point P1, and gradually declines therefrom to reach zero at a point P2. This point P2 is a time point at which the load cell 21 no longer senses the force, and is nearly equivalent to a time point at which the golf ball 2 leaves the collision plate 23.

Ft(t) is the force in the x direction (i.e. shear force), and gradually rises from the point P0 to reach a maximum value at a point P3, and gradually declines therefrom to become a negative value after a point P4. Then, Ft(t) reaches a minimum value at a point P5, and gradually rises therefrom to turn into a positive value again at a point P6. The shear force applied to the golf ball 2 after the point P6 is a curve shown by a dotted line in FIG. 4. Since the golf ball 2 leaves the load cell 21 at the point P2, the curve of Ft(t) sensed by the load cell 21 extends towards the point P2 and becomes zero at the point P2, as shown by a solid line.

An area Sa of a region hatched with an up-right diagonal line among regions surrounded by the curve of Ft(t) and the time axis represents an impulse where the shear force is positive. Further, an area Sb of a region hatched with an up-left diagonal line among the regions surrounded by the curve of Ft(t) and the time axis represents an impulse where the shear force is negative. In addition, an area Sc of a region hatched with a vertical line among the regions surrounded by the curve of Ft(t) and the time axis represents an impulse where the shear force is positive.

The impulse Sa is an impulse of the force acting in the positive direction of the x axis, and thus acts in a direction promoting the back spin. In other words, the impulse Sa is the back spin impulse in the present disclosure. The impulse Sb is an impulse of the force acting in the negative direction of the x axis, and thus acts in a direction inhibiting the back spin. In other words, the impulse Sb is the top spin impulse in the present disclosure. A greater value obtained by subtracting the impulse Sb from the impulse Sa (hereinafter, this value is also referred to as "impulse difference") means a back spin is more easily imparted to the golf ball.

As described above, T1 shown in FIG. 4 is a time from the start of the collision till the sign of Fn(t) reaches zero from an initial positive value, that is a time from the point P0 to the point P2. T2 is a time from a start of the collision till the sign of Ft(t) turns into a negative value from an initial positive value, that is a time from the point P0 to the point P4.

[Materials for Forming Golf Ball]

Next, the materials for forming the golf ball according to the present disclosure will be explained. The inner core and the outer core of the golf ball according to the present disclosure are preferably formed from a rubber composition containing (a) a base rubber, (b) an α,β-unsaturated carboxylic acid having 3 to 8 carbon atoms and/or a metal salt thereof as a co-crosslinking agent, and (c) a crosslinking initiator.

Next, the rubber composition for forming the inner core is referred to as "inner core rubber composition", and the rubber composition for forming the outer core is referred to as "outer core rubber composition". In the present disclosure, the inner core rubber composition and the outer core rubber composition may be identical or different.

((a) Base Rubber)

As (a) the base rubber, a natural rubber and/or a synthetic rubber can be used. For example, a polybutadiene rubber, a natural rubber, a polyisoprene rubber, a styrene polybutadiene rubber, or an ethylene-propylene-diene rubber (EPDM) can be used. These rubbers may be used solely, or at least two of these rubbers may be used in combination. Among them, particularly preferred is a high-cis polybutadiene having a cis-1,4 bond in an amount of 40 mass % or more, preferably 80 mass % or more, and more preferably 90 mass % or more in view of their superior resilience.

The high-cis polybutadiene preferably has a 1,2-vinyl bond in an amount of 2 mass % or less, more preferably 1.7 mass % or less, and even more preferably 1.5 mass % or less. If the amount of the 1,2-vinyl bond is excessively high, the resilience may be lowered.

The high-cis polybutadiene is preferably a polybutadiene synthesized using a rare earth element catalyst. When a neodymium catalyst, which employs a neodymium compound that is a lanthanum series rare earth element compound, is used, a polybutadiene rubber having a high content of a cis-1,4 bond and a low content of a 1,2-vinyl bond is obtained with excellent polymerization activity. Such a polybutadiene rubber is particularly preferred.

The high-cis polybutadiene preferably has a Mooney viscosity ($ML_{1+4}$ (100)° C.) of 30 or more, more preferably 32 or more, even more preferably 35 or more, and preferably has a Mooney viscosity ($ML_{1+4}$ (100° C.)) of 140 or less, more preferably 120 or less, even more preferably 100 or less, and most preferably 80 or less. It is noted that the Mooney viscosity ($ML_{1+4}$ (100° C.)) in the present disclosure is a value measured according to JIS K6300 using an L rotor under the conditions of: a preheating time of 1 minute; a rotor revolution time of 4 minutes; and a temperature of 100° C.

The high-cis polybutadiene preferably has a molecular weight distribution Mw/Mn (Mw: weight average molecular weight, Mn: number average molecular weight) of 2.0 or more, more preferably 2.2 or more, even more preferably 2.4 or more, and most preferably 2.6 or more, and preferably has a molecular weight distribution Mw/Mn of 6.0 or less, more preferably 5.0 or less, even more preferably 4.0 or less, and most preferably 3.4 or less. If the molecular weight distribution (Mw/Mn) of the high-cis polybutadiene is excessively low, the processability deteriorates. If the molecular weight distribution (Mw/Mn) of the high-cis polybutadiene is excessively high, the resilience may be lowered. It is noted that the measurement of the molecular weight distribution is conducted by gel permeation chromatography ("HLC-8120GPC", available from Tosoh Corporation) using a differential refractometer as a detector under the conditions of column: GMHHXL (available from Tosoh Corporation), column temperature: 40° C., and mobile phase: tetrahydrofuran, and calculated by converting based on polystyrene standard.

In the present disclosure, as (a) the base rubber, the polybutadiene is preferably used, the high-cis polybutadiene having the cis-1,4 bond in an amount of 90 mass % or more is more preferably used.

[(b) Co-Crosslinking Agent]

(b) The α,β-unsaturated carboxylic acid having 3 to 8 carbon atoms and/or the metal salt thereof is blended as a co-crosslinking agent in the rubber composition, and has an action of crosslinking a rubber molecule by graft polymerization to a base rubber molecular chain.

Examples of the α,β-unsaturated carboxylic acid having 3 to 8 carbon atoms include acrylic acid, methacrylic acid, fumaric acid, maleic acid and crotonic acid.

Examples of the metal ion constituting the metal salt of the α,β-unsaturated carboxylic acid having 3 to 8 carbon atoms include a monovalent metal ion such as sodium, potassium and lithium; a divalent metal ion such as magnesium, calcium, zinc, barium and cadmium; a trivalent metal ion such as aluminum; and other metal ion such as tin and zirconium. The above metal component may be used solely or as a mixture of at least two of them. Among them, the divalent metal ion such as magnesium, calcium, zinc, barium and cadmium is preferably used as the metal component. This is because if the divalent metal salt of the α,β-unsaturated carboxylic acid having 3 to 8 carbon atoms is used, a metal crosslinking easily generates between the rubber molecules. Especially, as the divalent metal salt, zinc acrylate is preferable, because use of zinc acrylate enhances the resilience of the obtained golf ball. It is noted that the α,β-unsaturated carboxylic acid having 3 to 8 carbon atoms and/or the metal salt thereof may be used solely, or two or more of them may be used in combination.

The amount of (b) the α,β-unsaturated carboxylic acid having 3 to 8 carbon atoms and/or the metal salt thereof is preferably 20 parts by mass or more, more preferably 21 parts by mass or more, and even more preferably 22 parts by mass or more, and is preferably 50 parts by mass or less, more preferably 45 parts by mass or less, and even more preferably 35 parts by mass or less, with respect to 100 parts by mass of (a) the base rubber. If the amount of (b) the α,β-unsaturated carboxylic acid having 3 to 8 carbon atoms and/or the metal salt thereof is less than 20 parts by mass, the amount of (c) the crosslinking initiator which will be described later must be increased such that the inner core and outer core formed from the rubber composition has an appropriate hardness, which tends to lower the resilience of the obtained golf ball. On the other hand, if the amount of the α,β-unsaturated carboxylic acid having 3 to 8 carbon atoms and/or the metal salt thereof is more than 50 parts by mass, the inner core and outer core formed from the rubber composition becomes so hard that the shot feeling of the obtained golf ball may be lowered.

((c) Crosslinking Initiator)

(c) The crosslinking initiator is blended to crosslink (a) the base rubber component. As (c) the crosslinking initiator, an organic peroxide is suitable. Specific examples of the organic peroxide include dicumyl peroxide, 1,1-bis(t-butylperoxy)-3,3,5-trimethylcyclohexane, 2,5-dimethyl-2,5-di(t-butylperoxy) hexane and di-t-butyl peroxide. These organic peroxides may be used solely, or two or more of them may be used in combination. Among them, dicumyl peroxide is preferably used.

The amount of (c) the crosslinking initiator is preferably 0.2 part by mass or more, more preferably 0.5 part by mass or more, and even more preferably 0.7 part by mass or more, and is preferably 5.0 parts by mass or less, more preferably 2.5 parts by mass or less, and even more preferably 2.0 parts by mass or less, with respect to 100 parts by mass of (a) the base rubber. If the amount of (c) the crosslinking initiator is less than 0.2 part by mass, the inner core and outer core formed from the rubber composition is so soft that the resilience of the obtained golf ball tends to be lowered, and if the amount of (c) the crosslinking initiator is more than 5.0 parts by mass, the amount of (b) the co-crosslinking agent described above must be decreased such that the inner core and outer core formed from the rubber composition has an appropriate hardness, which tends to lower the resilience or worsen the durability of the obtained golf ball.

((d) Metal Compound)

In the case that the rubber composition contains only the α,β-unsaturated carboxylic acid having 3 to 8 carbon atoms as the co-crosslinking agent, the rubber composition preferably further contains (d) a metal compound. Neutralizing the α,β-unsaturated carboxylic acid having 3 to 8 carbon atoms with the metal compound in the rubber composition provides substantially the same effect as using the metal salt of the α,β-unsaturated carboxylic acid having 3 to 8 carbon atoms as the co-crosslinking agent. It is noted that when the metal salt of the α,β-unsaturated carboxylic acid having 3 to 8 carbon atoms is used as the co-crosslinking agent, (d) the metal compound may be used as an optional component.

Examples of (d) the metal compound include a metal hydroxide such as magnesium hydroxide, zinc hydroxide, calcium hydroxide, sodium hydroxide, lithium hydroxide, potassium hydroxide, and copper hydroxide; a metal oxide such as magnesium oxide, calcium oxide, zinc oxide, and copper oxide; and a metal carbonate such as magnesium carbonate, zinc carbonate, calcium carbonate, sodium carbonate, lithium carbonate, and potassium carbonate. As (d) the metal compound, the divalent metal compound is preferable, the zinc compound is more preferable. This is because the divalent metal compound reacts with the α,β-unsaturated carboxylic acid having 3 to 8 carbon atoms to form a metal crosslinking. In addition, if the zinc compound is used, the obtained golf ball has better resilience.

(d) The metal compound may be used solely, or at least two of them may be used in combination. In addition, the amount of (d) the metal compound may be appropriately adjusted according to the desired neutralization degree of (b) the α,β-unsaturated carboxylic acid having 3 to 8 carbon atoms.

((e) Organic Sulfur Compound)

The rubber composition may further contain (e) an organic sulfur compound. If (e) the organic sulfur compound is contained, the obtained core has further enhanced resilience.

Examples of (e) the organic sulfur compound include thiols, polysulfides, thiurams, thiocarboxylic acids, dithiocarboxylic acids, sulfenamides, dithiocarbamates, and thiazoles.

Examples of the thiols include thiophenols and thionaphthols. Examples of the thiophenols include thiophenol; thiophenols substituted with a fluoro group, such as 4-fluorothiophenol, 2,4-difluorothiophenol, 2,5-difluorothiophenol, 2,6-difluorothiophenol, 2,4,5-trifluorothiophenol, 2,4,5,6-tetrafluorothiophenol and pentafluorothiophenol; thiophenols substituted with a chloro group, such as 2-chlorothiophenol, 4-chlorothiophenol, 2,4-dichlorothiophenol, 2,5-dichlorothiophenol, 2,6-dichlorothiophenol, 2,4,5-trichlorothiophenol, 2,4,5,6-tetrachlorothiophenol and pentachlorothiophenol; thiophenols substituted with a bromo group, such as 4-bromothiophenol, 2,4-dibromothiophenol, 2,5-dibromothiophenol, 2,6-dibromothiophenol, 2,4,5-tribromothiophenol, 2,4,5,6-tetrabromothiophenol and pentabromothiophenol; thiophenols substituted with an iodo group, such as 4-iodothiophenol, 2,4-diiodothiophenol, 2,5-diiodothiophenol, 2,6-diiodothiophenol, 2,4,5-triiodothiophenol, 2,4,5,6-tetraiodothiophenol and pentaiodothiophenol; and metal salts thereof.

Examples of the thionaphthols (naphthalenethiols) include 2-thionaphthol, 1-thionaphthol, 1-chloro-2-thionaphthol, 2-chloro-1-thionaphthol, 1-bromo-2-thionaphthol, 2-bromo-1-thionaphthol, 1-fluoro-2-thionaphthol, 2-fluoro-1-thionaphthol, 1-cyano-2-thionaphthol, 2-cyano-1-thionaphthol, 1-acetyl-2-thionaphthol, 2-acetyl-1-thionaphthol, and metal salts thereof.

The polysulfides are organic sulfur compounds having a polysulfide bond, and examples thereof include disulfides, trisulfides, and tetrasulfides.

Examples of the thiurams include thiuram monosulfides such as tetramethylthiuram monosulfide; thiuram disulfides such as tetramethylthiuram disulfide, tetraethylthiuram disulfide and tetrabutylthiuram disulfide; and thiuram tetrasulfides such as dipentamethylenethiuram tetrasulfide. Examples of the thiocarboxylic acids include naphthalene thiocarboxylic acid. Examples of the dithiocarboxylic acids include naphthalene dithiocarboxylic acid. Examples of the sulfenamides include N-cyclohexyl-2-benzothiazole sulfenamide, N-oxydiethylene-2-benzothiazole sulfenamide, and N-t-butyl-2-benzothiazole sulfenamide.

(e) The organic sulfur compound may be used solely, or two or more of them may be used in combination.

The amount of (e) the organic sulfur compound is preferably 0.05 part by mass or more, more preferably 0.1 part by mass or more, and even more preferably 0.2 part by mass or more, and is preferably 5.0 parts by mass or less, more preferably 3.0 parts by mass or less, and even more preferably 2.0 parts by mass or less, with respect to 100 parts by mass of (a) the base rubber. If the amount of (e) the organic sulfur compound is less than 0.05 part by mass, the effect of adding (e) the organic sulfur compound may not be obtained, and the resilience of the golf ball may not be enhanced. In addition, if the amount of (e) the organic sulfur compound is more than 5.0 parts by mass, the obtained golf ball has a great compression deformation amount and thus the resilience thereof may be lowered.

((f) Other Component)

The rubber composition may further contain an additive such as a pigment, a filler for adjusting weight or the like, an antioxidant, a peptizing agent, and a softener, where necessary.

The filler blended in the rubber composition is mainly used as a weight adjusting agent for adjusting the weight of the golf ball obtained as a final product, and may be blended where necessary. Examples of the filler include an inorganic filler such as zinc oxide, barium sulfate, calcium carbonate, magnesium oxide, tungsten powder, and molybdenum powder. The amount of the filler is preferably 0.5 part by mass or more, more preferably 1 part by mass or more, and is preferably 30 parts by mass or less, more preferably 25 parts by mass or less, and even more preferably 20 parts by mass or less, with respect to 100 parts by mass of (a) the base rubber. If the amount of the filler is less than 0.5 part by mass, it is difficult to adjust the weight, and if the amount of the filler is more than 30 parts by mass, the weight proportion of the rubber component is decreased and thus the resilience tends to be lowered.

The amount of the antioxidant is preferably 0.1 part by mass or more and is preferably 1 part by mass or less with respect to 100 parts by mass of (a) the base rubber. In addition, the amount of the peptizing agent is preferably 0.1 part by mass or more and is preferably 5 parts by mass or less with respect to 100 parts by mass of (a) the base rubber.

The cover of the golf ball according to the present disclosure is preferably formed from a composition containing a resin component. Examples of the resin component include an ionomer resin, a thermoplastic polyurethane elastomer having a trade name of "Elastollan (registered trademark)" available from BASF Japan Ltd., a thermoplastic polyamide elastomer having a trade name of "Pebax (registered trademark)" available from Arkema K. K., a thermoplastic polyester elastomer having a trade name of "Hytrel (registered trademark)" available from Du Pont-Toray Co., Ltd., and a thermoplastic styrene elastomer having a trade name of "TEFABLOC (registered trademark)" available from Mitsubishi Chemical Corporation.

Examples of the ionomer resin include a product obtained by neutralizing at least a part of carboxyl groups in a binary copolymer composed of an olefin and an α,β-unsaturated carboxylic acid having 3 to 8 carbon atoms with a metal ion; a product obtained by neutralizing at least a part of carboxyl groups in a ternary copolymer composed of an olefin, an α,β-unsaturated carboxylic acid having 3 to 8 carbon atoms and an α,β-unsaturated carboxylic acid ester with a metal ion; and a mixture thereof. The olefin is preferably an olefin having 2 to 8 carbon atoms.

Examples of the olefin include ethylene, propylene, butene, pentene, hexene, heptene and octene, and ethylene is particularly preferred. Examples of the α,β-unsaturated carboxylic acid having 3 to 8 carbon atoms include acrylic acid, methacrylic acid, fumaric acid, maleic acid and crotonic acid, and acrylic acid or methacrylic acid is particularly preferred. In addition, examples of the α,β-unsaturated carboxylic acid ester include a methyl ester, an ethyl ester, a propyl ester, a n-butyl ester, an isobutyl ester of acrylic acid, methacrylic acid, fumaric acid and maleic acid, and acrylic acid ester or methacrylic acid ester is particularly preferred. Among them, as the ionomer resin, a metal ion neutralized product of ethylene-(meth)acrylic acid binary copolymer or a metal ion neutralized product of ethylene-(meth)acrylic acid-(meth)acrylic acid ester ternary copolymer is preferred.

The composition for forming the cover of the golf ball according to the present disclosure preferably contains a thermoplastic polyurethane elastomer or an ionomer resin as the resin component. The amount of the polyurethane or ionomer resin in the resin component of the composition is preferably 50 mass % or more, more preferably 60 mass % or more, and even more preferably 70 mass % or more. It is noted that in the case of the multiple layered cover, the outer cover layer is preferably formed from the composition containing the thermoplastic polyurethane elastomer, and the inner cover layer is preferably formed from the composition containing the ionomer resin.

In addition to the resin component, the composition for forming the cover of the golf ball according to the present disclosure may further contain a pigment component such as a white pigment (e.g. titanium oxide), a blue pigment and a red pigment, a weight adjusting agent such as zinc oxide, calcium carbonate and barium sulfate, a dispersant, an antioxidant, an ultraviolet absorber, a light stabilizer, a fluorescent material or fluorescent brightener, as long as they do not impair the performance of the cover.

The amount of the white pigment (e.g. titanium oxide) is preferably 0.5 part or more, more preferably 1 part or more, and is preferably 10 parts or less, more preferably 8 parts or less, with respect to 100 parts by mass of the resin component constituting the cover. If the amount of the white pigment is 0.5 part by mass or more, it is possible to impart the opacity to the resultant cover. In addition, if the amount of the white pigment is more than 10 parts by mass, the durability of the resultant cover may deteriorate.

[Production Method of the Golf Ball According to the Present Disclosure]

First, (a) the base rubber, (b) the α,β-unsaturated carboxylic acid having 3 to 8 carbon atoms and/or the metal salt as the co-crosslinking agent, (c) the crosslinking initiator, and other optional component such as (d) the metal compound, (e) the organic sulfur compound and (f) the other component used where necessary are blended and kneaded to prepare the rubber composition. The kneading method is not particularly limited. For example, the kneading is conducted with a conventional kneading machine such as a kneading roll, a banbury mixer and a kneader. As described above, the inner core rubber composition and the outer core rubber composition may be identical or different.

The obtained inner core rubber composition is extruded into a rod shape with an extruding machine and cut into a predetermined length, to prepare a preliminarily molded product (also referred to as "plug"). Further, the plug may be prepared by molding the inner core rubber composition into a sheet shape having a certain thickness and punching the sheet of the inner core rubber composition. The size of the plug appropriately varies depending on the size of the mold for compression molding. The obtained plug is preferably, for example, immersed into an anti-adhesion agent liquid such that the plug does not adhere to each other, and aged for about 8 hours to 48 hours after being dried. Subsequently, the plugs are charged into a core molding mold, and pressed and molded.

The inner core is formed from the prepared inner core rubber composition. In the present disclosure, the inner core is preferably molded by pressing the inner core rubber composition under the following conditions.

(1) The pressing temperature is preferably 150° C. or more, more preferably 160° C. or more, and is preferably 200° C. or less, more preferably 180° C. or less.

(2) The pressing time is preferably 10 minutes or more, more preferably 15 minutes or more, and is preferably 40 minutes or less, more preferably 30 minutes or less.

It is noted that the pressure when performing the molding is not particularly limited, and preferably ranges from 2.9 MPa to 11.8 MPa.

Next, the outer core covering the inner core is formed. Examples of the method for molding the outer core include a method which comprises molding the outer core rubber composition into a hollow shell, covering the inner core with a plurality of the hollow shells and performing compression molding (preferably a method which comprises molding the outer core rubber composition into a hollow half-shell, covering the inner core with two of the half-shells and performing compression molding).

Molding the outer core rubber composition into the hollow shell is carried out, for example, at a temperature of 10° C. or more and 100° C. or less under a pressure of 1 MPa or more and 20 MPa or less.

Examples of the method of covering the inner core with shells formed from the outer core rubber composition and molding the outer core include a one-step heat-pressing method, or a two-step heat-pressing method.

In the present disclosure, when the outer core is molded by the one-step heat-pressing method, the outer core is preferably molded under the following conditions.

(1) The pressing temperature is preferably 130° C. or more, more preferably 140° C. or more, and is preferably 180° C. or less, more preferably 170° C. or less.

(2) The pressing time is preferably 10 minutes or more, more preferably 15 minutes or more, and is preferably 40 minutes or less, more preferably 30 minutes or less.

In addition, when the outer core is molded by the two-step heat-pressing method, the outer core is preferably molded under the following conditions.

The first molding step is preferably conducted under the following conditions.

(1) The pressing temperature is preferably 100° C. or more, more preferably 110° C. or more, and is preferably 150° C. or less, more preferably 140° C. or less.

(2) The pressing time is preferably 40 minutes or more, more preferably 50 minutes or more, and is preferably 90 minutes or less, more preferably 80 minutes or less.

The second molding step is preferably conducted under the following conditions.

(1) The pressing temperature is preferably 150° C. or more, more preferably 160° C. or more, and is preferably 200° C. or less, more preferably 180° C. or less.

(2) The pressing time is preferably 5 minutes or more, more preferably 8 minutes or more, and is preferably 20 minutes or less, more preferably 15 minutes or less.

It is noted that the pressure when performing the molding is not particularly limited, and preferably ranges from 2.9 MPa to 11.8 MPa.

[Cover]

Examples of the method for molding the cover of the golf ball according to the present disclosure include a method which comprises molding the cover composition into a hollow shell, covering the core with a plurality of the hollow shells and performing compression molding (preferably a method which comprises molding the cover composition into a hollow half-shell, covering the core with two of the half-shells and performing compression molding); and a method which comprises injection molding the cover composition directly onto the core.

When molding the cover in a compression molding method, molding of the half shell is performed by either the compression molding method or the injection molding method, and the compression molding method is preferred. Compression molding the cover composition into a half shell is carried out, for example, under a pressure of 1 MPa or more and 20 MPa or less at a temperature of −20° C. or more and 70° C. or less relative to the flow beginning temperature of the cover composition. By performing the molding under the above conditions, the half shell having a uniform thickness is formed. Compression molding half shells into the cover is carried out, for example, under a pressure of 0.5 MPa or more and 25 MPa or less at a temperature of −20° C. or more and 70° C. or less relative to the flow beginning temperature of the cover composition. By performing the molding under the above conditions, the golf ball cover having a uniform thickness is formed.

In the case of injection molding the cover composition into the cover, the cover composition extruded in a pellet form may be used for injection molding, or the cover materials such as the base resin components and the pigment may be dry blended, followed by directly injection molding the blended material. It is preferred to use upper and lower molds having a hemi-spherical cavity and pimples for forming the cover, wherein a part of the pimples also serves as a retractable hold pin. When molding the cover by injection molding, the hold pin is protruded to hold the core, the cover composition is charged and then cooled to obtain the cover. For example, the cover composition heated at a temperature ranging from 200° C. to 280° C. is charged into a mold held under a pressure of 9 MPa to 15 MPa for 0.2 to 5 seconds, and after cooling for 10 to 60 seconds, the mold is opened to obtain the cover.

Concave portions called "dimples" are usually formed on the surface of the cover when the cover is molded. The total number of dimples formed on the cover is preferably 200 or more and 500 or less. If the total number of dimples is less than 200, the dimple effect is hardly obtained. On the other hand, if the total number of dimples exceeds 500, the dimple effect is hardly obtained because the size of the respective dimple is small. The shape (shape in a plan view) of the dimples formed on the cover includes, without limitation, a circle; a polygonal shape such as a roughly triangular shape, a roughly quadrangular shape, a roughly pentagonal shape and a roughly hexagonal shape; and other irregular shape. These shapes may be employed solely, or at least two of them may be employed in combination.

The golf ball body having the cover formed thereon is ejected from the mold, and is preferably subjected to surface treatments such as deburring, cleaning and sandblast where necessary. In addition, if desired, a paint film or a mark may be formed. The thickness of the paint film is not particularly limited, and is preferably 5 μm or more, more preferably 7 μm or more, and is preferably 50 μm or less, more preferably 40 μm or less, and even more preferably 30 μm or less. If the thickness of the paint film is less than 5 μm, the paint film is easy to wear off due to the continued use of the golf ball, and if the thickness of the paint film exceeds 50 μm, the dimple effect is reduced and thus the flight performance of the golf ball may be lowered.

EXAMPLES

Next, the present disclosure will be described in detail by way of examples. However, the present disclosure is not limited to the examples described below. Various changes and modifications without departing from the spirit of the present disclosure are included in the scope of the present disclosure.

[Evaluation Method]

(1) Compression Deformation Amount

The deformation amount along the compression direction of the golf ball (shrinking amount along the compression direction of the golf ball), when applying a load from an initial load of 98 N to a final load of 1275 N to the golf ball, was measured.

(2) Core Hardness (Shore C Hardness)

The surface hardness was measured on the surface of the core. In addition, the core was cut into two hemispheres to obtain a cut plane, and the hardness at the central point of the cut plane and the hardness at predetermined distances from the central point of the cut plane were measured. The hardness was measured with an automatic hardness tester (Digitest II, available from Bareiss company) using a testing device of "Shore C".

(3) Slab Hardness (Shore D Hardness)

Sheets with a thickness of about 2 mm were produced by injection molding the resin composition. The sheets were stored at a temperature of 23° C. for two weeks. At least three of these sheets were stacked on one another so as not to be affected by the measuring substrate on which the sheets were placed, and the hardness of the stack was measured with an automatic hardness tester (Digitest II, available from Bareiss company) using a testing device of "Shore D".

(4) Spin Rate of Golf Ball when being Hit with Driver (W #1 Condition)

A driver provided with a titanium head (SRIXON Z785, loft angle: 9.5°, available from Sumitomo Rubber Industries, Ltd.) was installed on a swing robot M/C available from True Temper Sports, Inc. The golf ball was hit at a head speed of 50 m/sec, and the spin rate of the golf ball right after the hitting was measured. The measurement was conducted ten times for each golf ball, and the average value thereof was adopted as the measurement value for that golf ball. It is noted that the spin rate of the golf ball right after the hitting was measured by continuously taking a sequence of photographs of the hit golf ball.

(5) Spin Rate of Golf Ball when being Hit with 8-Iron (I #8 Condition)

An 8-iron provided with a titanium head (SRIXON Z785, loft angle: 36°, available from Sumitomo Rubber Industries, Ltd.) was installed on a swing robot M/C available from True Temper Sports, Inc. The golf ball was hit at a head speed of 39 m/sec, and the spin rate of the golf ball right after the hitting was measured. The measurement was conducted ten times for each golf ball, and the average value thereof was adopted as the measurement value for that golf ball. It is noted that the spin rate of the golf ball right after the hitting was measured by continuously taking a sequence of photographs of the hit golf ball.

Figure 5:
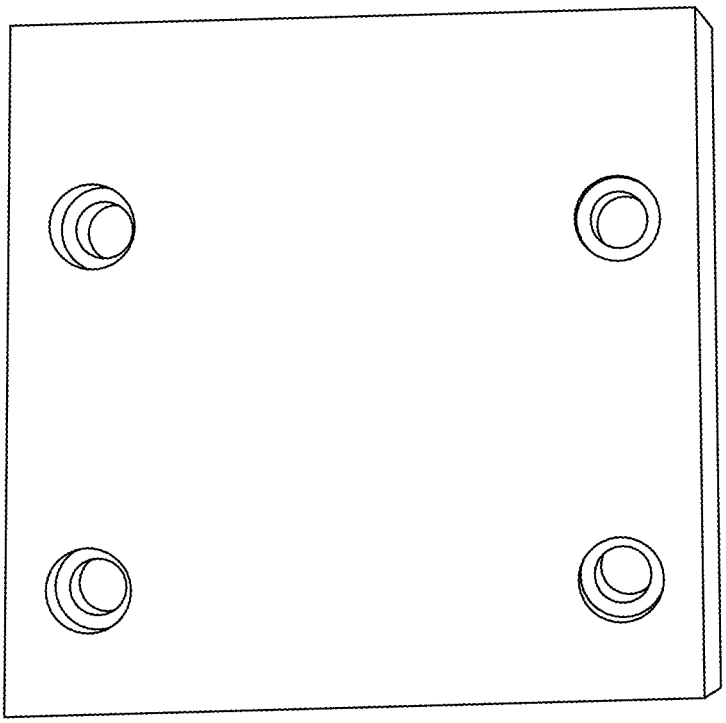
FIG. 5 is a photograph substitute for a drawing showing a face surface of a driver.

(6) Back Spin Impulse and Top Spin Impulse Under a Condition (W #1 Condition) Corresponding to a Condition when the Golf Ball is Hit with a Driver The contact force tester shown in FIG. 2 was used to measure the back spin impulse and the top spin impulse. Specifically, the golf ball was launched from the launcher at a launching speed of 42 m/sec, and collided with the striking face of the collision plate 23 inclined at an angle of 13 degrees ($\alpha$=13 degrees) to the flying direction (vertical direction) of the golf ball. At that time, the shear force was measured with the load cell provided under the collision plate 23 from the time the golf ball contacted the collision plate 23 to the time the golf ball leaved the collision plate 23, and the back spin impulse and the top spin impulse were determined based on the obtained waveforms. As the collision plate 23, the titanium plate shown in FIG. 5 was used. The measurement was conducted eighteen times for each golf ball, and the average value thereof was adopted as the measurement value for that golf ball.

Figure 6:
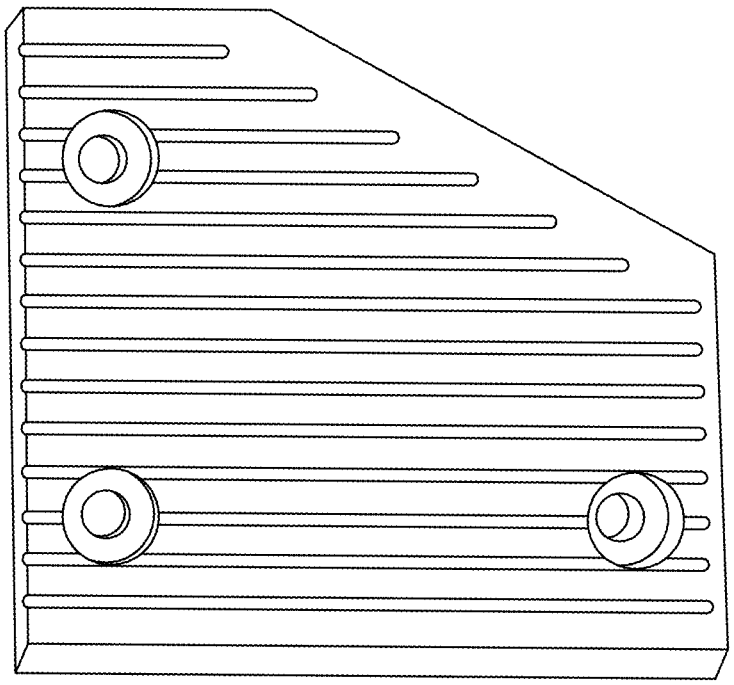
FIG. 6 is a photograph substitute for a drawing showing a face surface of an 8-iron.

(7) Back Spin Impulse and Top Spin Impulse Under a Condition (I #8 Condition) Corresponding to a Condition when the Golf Ball is Hit with an 8-Iron The measurement was conducted in the same manner as the method in the above-described (6), except that the launching speed of the golf ball was 32 m/sec, the inclined angle (a) of the collision plate 23 was 36 degrees, and a face surface (FIG. 6) of an 8-iron (SRIXON Z785 available from Sumitomo Rubber Industries, Ltd.) was used as the collision plate 23.

[Production of Golf Ball]

(1) Production of Inner Core

According to the formulations shown in Table 1, the inner core rubber compositions were kneaded, and heat-pressed under predetermined conditions in upper and lower molds, each having a hemispherical cavity, to produce spherical inner cores having a diameter of 20 mm. It is noted that the amount of barium sulfate was adjusted such that the finally obtained golf balls had a mass of 45.3 g.

TABLE 1

| Inner core No. | | a | b | c | d |
|---|---|---|---|---|---|
| Formulation (parts by mass) | BR730 | 100 | 100 | 100 | 100 |
| | ZN-DA90S | 15 | 24 | 15 | 24 |
| | Zinc oxide | 5 | 5 | 5 | 5 |
| | Barium sulfate | Appropriate amount | Appropriate amount | Appropriate amount | Appropriate amount |
| | Percumyl D | 0.8 | 0.8 | 0.8 | 0.8 |
| Vulcanization condition | Temperature (° C.) | 125 | 125 | 170 | 170 |
| | Time (min) | 60 | 60 | 20 | 20 |
| Hardness distribution | | Flat | Flat | Outer-hard and inner-soft | Outer-hard and inner-soft |

(1) Production of Outer Core

According to the formulation shown in Table 2, the outer core rubber composition was kneaded, and half shells were molded from the outer core rubber composition. The outer core rubber composition was charged into each of the depressed part of the lower mold for molding half shells, and a pressure was applied to mold half shells. The compression molding was carried out at a temperature of 25° C. for 3 minutes under a pressure of 15 MPa. The inner core obtained above was covered with two of the half shells. The inner core and the half shell were together charged into the mold composed of the upper mold and the lower mold, each having a hemispherical cavity, and heat-pressed under predetermined conditions, to obtain spherical cores (thickness of outer core: 9.85 mm). It is noted that the amount of barium sulfate was adjusted such that the finally obtained golf balls had a mass of 45.3 g.

TABLE 2

| Outer core No. | | | A | B | C | D | E | F |
|---|---|---|---|---|---|---|---|---|
| Formulation (parts by mass) | BR730 | | 100 | 100 | 100 | 100 | 100 | 100 |
| | ZN-DA90S | | 23 | 25.5 | 28 | 24 | 30 | 45 |
| | Zinc oxide | | 5 | 5 | 5 | 5 | 5 | 5 |
| | YS POLYSTER T130 | | — | — | — | — | — | 10 |
| | Barium sulfate | | Appropriate amount | Appropriate amount | Appropriate amount | Appropriate amount | Appropriate amount | Appropriate amount |
| | Percumyl D | | 0.8 | 0.8 | 0.8 | 0.8 | 0.8 | 1.0 |
| Vulcanization condition | Vulcanization condition 1 | Temperature (° C.) | 125 | 125 | 125 | 155 | 155 | 142 |
| | | Time (min) | 60 | 60 | 60 | 20 | 20 | 16 |
| | Vulcanization condition 2 | Temperature (° C.) | 170 | 170 | 170 | — | — | 160 |
| | | Time (min) | 10 | 10 | 10 | — | — | 10 |
| Hardness distribution | | | Flat | Flat | Flat | Outer-hard and inner-soft | Outer-hard and inner-soft | Outer-soft and inner-hard |

The materials used in Tables 1 and 2 are shown as follows.

BR730: high-cis polybutadiene rubber (cis-1,4 bond amount=95 mass %, 1,2-vinyl bond amount=1.3 mass %, Moony viscosity ($ML_{1+4}$ (100° C.))=55, molecular weight distribution (Mw/Mn)=3) available from JSR Corporation ZN-DA90S: zinc acrylate available from Nisshoku Techno Fine Chemical Co., Ltd.

Percumyl (registered trademark) D: dicumyl peroxide available from NOF Corporation Zinc oxide: "Ginrei R" available from Toho Zinc Co., Ltd.

Barium sulfate: "Barium sulfate BD" available from Sakai Chemical Industry Co., Ltd.

YS POLYSTER T130: terpene phenolic resin available from Yasuhara Chemical Co., Ltd.

(3) Production of Intermediate Layer

According to the formulation shown in Table 3, the materials were mixed with a twin-screw kneading extruder to prepare the intermediate layer composition in a pellet form. The extruding conditions were a screw diameter of 45 mm, a screw rotational speed of 200 rpm, and a screw L/D=35, and the mixture was heated to 200° C. to 260° C. at the die position of the extruder. The intermediate layer composition was directly injection molded on the above obtained spherical core, to form the intermediate layer having a thickness of 1.0 mm covering the spherical core, thereby producing the intermediate layer-covered spherical body. Upper and lower molds for the molding have a hemi-spherical cavity and a retractable hold pin for holding the spherical body. When molding the intermediate layer, the hold pin was protruded to hold the spherical core, the intermediate layer composition heated at a temperature of 260° C. was charged for 0.3 seconds into the mold held under a pressure of 80 tons, and then cooled for 30 seconds, and the mold was opened to obtain the intermediate layer-covered spherical body.

TABLE 3

| Intermediate layer composition | | |
|---|---|---|
| Formulation (parts by mass) | Surlyn 8945 | 55 |
| | Himilan AM7329 | 45 |
| | Titanium dioxide | 4 |

The materials used in Table 3 are shown as follows.

Surlyn (registered trademark) 8945: sodium ion-neutralized ethylene-methacrylic acid copolymer ionomer resin available from E.I. du Pont de Nemours and Company.

Himilan (registered trademark) AM7329: zinc ion-neutralized ethylene-methacrylic acid copolymer ionomer resin available from Du Pont-Mitsui Polychemicals Co., Ltd.

(4) Production of Cover

According to the formulation shown in Table 4, the materials were mixed with a twin-screw kneading extruder to prepare the cover composition in a pellet form. The extruding conditions were a screw diameter of 45 mm, a screw rotational speed of 200 rpm, and a screw L/D=35, and the mixture was heated to 200° C. to 260° C. at the die position of the extruder. The obtained cover composition in the pellet form was charged into each of the depressed part of the lower mold for molding half shells one by one, and a pressure was applied to mold half shells. The compression molding was carried out at a temperature of 170° C. for 5 minutes under a pressure of 2.94 MPa. The intermediate layer-covered spherical body obtained above was concentrically covered with two of the half shells. The cover having a thickness of 0.5 mm was formed by compression molding. The compression molding was carried out at a temperature of 145° C. for 2 minutes under a pressure of 9.8 MPa.

TABLE 4

| Cover composition | | |
|---|---|---|
| Formulation (parts by mass) | Elastollan XNY82A | 100 |
| | Tinuvin 770 | 0.2 |
| | Titanium dioxide | 4 |
| | Ultramarine blue | 0.04 |
| Hardness (Shore D) | | 29 |

The materials used in Table 4 are shown as follows.

Elastollan (registered trademark) XNY82A: thermoplastic polyurethane elastomer available from BASF Japan Ltd.

Tinuvin (registered trademark) 770: Sebacic acid bis(2,2,6,6-tetramethyl-4-piperidyl) ester available from BASF Japan Ltd.

Evaluation results regarding the obtained golf balls are shown in Tables 5 and 6.

TABLE 5

| Golf ball No. | | | 1 | 2 | 3 |
|---|---|---|---|---|---|
| Core | Composition | Outer core No. | B | A | C |
| | | Inner core No. | d | d | d |
| | Hardness distribution of inner core (Shore C) | Center hardness (Ho) | 61 | 61 | 61 |
| | | Hardness at 2.5 mm point (H2.5) | 64 | 64 | 64 |
| | | Hardness at 5 mm point (H5) | 70 | 70 | 70 |
| | | Hardness at 7.5 mm point (H7.5) | 76 | 76 | 76 |
| | | Hardness at 9 mm point (H9) | 82 | 82 | 82 |
| | | Average hardness (a) of H2.5 and H5 | 67 | 67 | 67 |
| | | Average hardness (b) of H7.5 and H9 | 79 | 79 | 79 |
| | | Hardness difference between H9 and Ho (H9-Ho) | 21 | 21 | 21 |
| | | Hardness distribution shape | Outer-hard and inner-soft | Outer-hard and inner-soft | Outer-hard and inner-soft |
| | Hardness distribution of outer core (Shore C) | Hardness at 11 mm point (H11) | 78 | 78 | 81 |
| | | Hardness at 12.5 mm point (H12.5) | 78 | 78 | 81 |
| | | Hardness at 15 mm point (H15) | 78 | 78 | 81 |
| | | Surface hardness (Hs) | 84 | 82 | 86 |
| | | Hardness difference between Hs and H11 (Hs-H11) | 6 | 4 | 6 |
| | | Hardness distribution shape | Flat | Flat | Flat |
| Ball | | Impulse difference A between back spin impulse and top spin impulse under W#1 condition (kN · μs) | 174 | 164 | 152 |
| | | Impulse difference B between back spin impulse and top spin impulse under I#8 condition (kN · μs) | 298 | 264 | 283 |
| | | A × a | 11,673 | 11,027 | 10,191 |
| | | B × b | 23,594 | 20,876 | 22,407 |
| | | (B × b)/(A × a) | 2.02 | 1.89 | 2.20 |
| | | B/A | 1.71 | 1.60 | 1.86 |
| | | Spin rate under W#1 condition (rpm) | 2546 | 2352 | 2438 |

TABLE 5-continued

| | | | | | |
|---|---|---|---|---|---|
| | | Spin rate under I#8 condition (rpm) | 7699 | 7771 | 8072 |
| | | Spin rate under I#8 condition/ Spin rate under W#1 condition | 3.02 | 3.30 | 3.31 |
| | | Compression deformation amount (mm) | 2.45 | 2.53 | 2.16 |

| | | | | |
|---|---|---|---|---|
| | | Golf ball No. | 4 | 5 |
| Core | Composition | Outer core No. | E | D |
| | | Inner core No. | d | d |
| | Hardness distribution of inner core (Shore C) | Center hardness (Ho) | 61 | 61 |
| | | Hardness at 2.5 mm point (H2.5) | 64 | 64 |
| | | Hardness at 5 mm point (H5) | 70 | 70 |
| | | Hardness at 7.5 mm point (H7.5) | 76 | 76 |
| | | Hardness at 9 mm point (H9) | 82 | 82 |
| | | Average hardness (a) of H2.5 and H5 | 67 | 67 |
| | | Average hardness (b) of H7.5 and H9 | 79 | 79 |
| | | Hardness difference (H9-Ho) between H9 and Ho | 21 | 21 |
| | | Hardness distribution shape | Outer-hard and inner-soft | Outer-hard and inner-soft |
| | Hardness distribution of outer core (Shore C) | Hardness at 11 mm point (H11) | 75 | 68 |
| | | Hardness at 12.5 mm point (H12.5) | 77 | 72 |
| | | Hardness at 15 mm point (H15) | 81 | 77 |
| | | Surface hardness (Hs) | 88 | 83 |
| | | Hardness difference (Hs-H11) between Hs and H11 | 13 | 15 |
| | | Hardness distribution shape | Outer-hard and inner-soft | Outer-hard and inner-soft |
| Ball | | Impulse difference A between back spin impulse and top spin impulse under W#1 condition (kN · μs) | 162 | 139 |
| | | Impulse difference B between back spin impulse and top spin impulse under I#8 condition (kN · μs) | 302 | 259 |
| | | A × a | 10,873 | 9,322 |
| | | B × b | 23,911 | 20,484 |
| | | (B × b)/(A × a) | 2.20 | 2.20 |
| | | B/A | 1.86 | 1.86 |
| | | Spin rate under W#1 condition (rpm) | 2544 | 2422 |
| | | Spin rate under I#8 condition (rpm) | 7840 | 7349 |
| | | Spin rate under I#8 condition/ Spin rate under W#1 condition | 3.08 | 3.03 |
| | | Compression deformation amount (mm) | 2.30 | 2.73 |

TABLE 6

| | | | | | |
|---|---|---|---|---|---|
| | | Golf ball No. | 6 | 7 | 8 |
| Core | Composition | Outer core No. | A | B | B |
| | | Inner core No. | b | a | C |
| | Hardness distribution of inner core (Shore C) | Center hardness (Ho) | 79 | 64 | 51 |
| | | Hardness at 2.5 mm point (H2.5) | 79 | 65 | 55 |
| | | Hardness at 5 mm point (H5) | 80 | 66 | 60 |
| | | Hardness at 7.5 mm point (H7.5) | 81 | 67 | 66 |
| | | Hardness at 9 mm point (H9) | 81 | 69 | 72 |
| | | Average hardness (a) of H2.5 and H5 | 80 | 65 | 57 |
| | | Average hardness (b) of H7.5 and H9 | 81 | 68 | 69 |
| | | Hardness difference (H9-Ho) between H9 and Ho | 2 | 5 | 21 |
| | | Hardness distribution shape | Flat | Flat | Outer-hard and inner-soft |
| | Hardness distribution of outer core (Shore C) | Hardness at 11 mm point (H11) | 78 | 78 | 78 |
| | | Hardness at 12.5 mm point (H12.5) | 78 | 78 | 78 |
| | | Hardness at 15 mm point (H15) | 78 | 78 | 78 |
| | | Surface hardness (Hs) | 82 | 84 | 84 |
| | | Hardness difference (Hs-H11) between Hs and H11 | 4 | 6 | 6 |
| | | Hardness distribution shape | Flat | Flat | Flat |
| Ball | | Impulse difference A between back spin impulse and top spin impulse under W#1 condition (kN · μs) | 180 | 152 | 160 |
| | | Impulse difference B between back spin impulse and top spin impulse under I#8 condition (kN · μs) | 319 | 286 | 286 |

TABLE 6-continued

| | | | | | |
|---|---|---|---|---|---|
| | | A × a | 14,360 | 9,935 | 9,140 |
| | | B × b | 25,831 | 19,484 | 19,756 |
| | | (B × b)/(A × a) | 1.80 | 1.96 | 2.16 |
| | | B/A | 1.77 | 1.88 | 1.79 |
| | | Spin rate under W#1 condition (rpm) | 2682 | 2472 | 2486 |
| | | Spin rate under I#8 condition (rpm) | 8024 | 7262 | 7209 |
| | | Spin rate under I#8 condition /Spin rate under W#1 condition | 2.99 | 2.94 | 2.90 |
| | | Compression deformation amount (mm) | 2.44 | 2.55 | 2.57 |
| | | Golf ball No. | 9 | 10 | 11 |
| Core | Composition | Outer core No. | E | F | F |
| | | Inner core No. | a | a | d |
| | Hardness distribution of inner core (Shore C) | Center hardness (Ho) | 64 | 64 | 61 |
| | | Hardness at 2.5 mm point (H2.5) | 65 | 65 | 64 |
| | | Hardness at 5 mm point (H5) | 66 | 66 | 70 |
| | | Hardness at 7.5 mm point (H7.5) | 67 | 67 | 76 |
| | | Hardness at 9 mm point (H9) | 69 | 69 | 82 |
| | | Average hardness (a) of H2.5 and H5 | 65 | 65 | 67 |
| | | Average hardness (b) of H7.5 and H9 | 68 | 68 | 79 |
| | | Hardness difference (H9-Ho) between H9 and Ho | 5 | 5 | 21 |
| | | Hardness distribution shape | Flat | Flat | Outer-hard and inner-soft |
| | Hardness distribution of outer core (Shore C) | Hardness at 11 mm point (H11) | 75 | 81 | 81 |
| | | Hardness at 12.5 mm point (H12.5) | 77 | 81 | 81 |
| | | Hardness at 15 mm point (H15) | 81 | 78 | 78 |
| | | Surface hardness (Hs) | 88 | 69 | 69 |
| | | Hardness difference (Hs-H11) between Hs and H11 | 13 | −12 | −12 |
| | | Hardness distribution shape | Outer-hard and inner-soft | Outer-soft and inner-hard | Outer-soft and inner-hard |
| Ball | | Impulse difference A between back spin impulse and top spin impulse under W#1 condition (kN · μs) | 154 | 179 | 182 |
| | | Impulse difference B between back spin impulse and top spin impulse under I#8 condition (kN · μs) | 285 | 298 | 301 |
| | | A × a | 10,066 | 11,700 | 12,210 |
| | | B × b | 19,416 | 20,301 | 23,382 |
| | | (B × b)/(A × a) | 1.93 | 1.74 | 1.95 |
| | | B/A | 1.85 | 1.66 | 1.65 |
| | | Spin rate under W#1 condition (rpm) | 2469 | 2684 | 2826 |
| | | Spin rate under I#8 condition (rpm)/ | 7390 | 7886 | 8231 |
| | | Spin rate under I#8 condition Spin rate under W#1 condition | 2.99 | 2.94 | 2.91 |
| | | Compression deformation amount (mm) | 2.42 | 2.51 | 2.53 |

The golf balls No. 1 to 5 are golf balls comprising a spherical core having an inner core and an outer core, and a cover positioned outside the spherical core, wherein A×a is 12,200 or less and B×b is 20,400 or more, where "a" represents an average hardness (Shore C) of a hardness (H2.5) at a point of 2.5 mm from a center of the spherical core and a hardness (H5) at a point of 5 mm from the center of the spherical core, "b" represents an average hardness (Shore C) of a hardness (H7.5) at a point of 7.5 mm from the center of the spherical core and a hardness (H9) at a point of 9 mm from the center of the spherical core, "A" represents an impulse difference (kN·μs) between a back spin impulse and a top spin impulse measured using a contact force tester under a condition corresponding to a condition when the golf ball is hit with a driver, and "B" represents an impulse difference (kN·μs) between a back spin impulse and a top spin impulse measured using a contact force tester under a condition corresponding to a condition when the golf ball is hit with an 8-iron.

It can be seen from Table 5 that each of the golf balls No. 1 to 5 has a ratio (spin rate under I #8 condition/spin rate under W #1 condition) of the spin rate under I #8 condition to the spin rate under W #1 condition of 3.00 or more, and has an increased spin rate when being hit with an 8-iron while suppressing rise in a spin rate when being hit with a driver.

The golf ball according to the present disclosure has an increased spin rate when being hit with an 8-iron while suppressing rise in a spin rate when being hit with a driver.

The golf ball according to the present disclosure (1) is a golf ball comprising a spherical core having an inner core and an outer core, and a cover positioned outside the spherical core, wherein A×a is 12,200 or less, and B×b is 20,400 or more, where "a" represents an average hardness (Shore C) of a hardness (H2.5) at a point of 2.5 mm from a center of the spherical core and a hardness (H5) at a point of 5 mm from the center of the spherical core, "b" represents an average hardness (Shore C) of a hardness (H7.5) at a point of 7.5 mm from the center of the spherical core and a hardness (H9) at a point of 9 mm from the center of the spherical core, "A" represents an impulse difference (kN·μs) between a back spin impulse and a top spin impulse measured using a contact force tester under a condition corresponding to a condition when the golf ball is hit with a driver, and "B" represents an impulse difference (kN·μs) between a back spin impulse and a top spin impulse measured using a contact force tester under a condition corresponding to a condition when the golf ball is hit with an 8-iron.

The golf ball according to the present disclosure (2) is the golf ball according to the present disclosure (1), wherein a ratio ((B×b)/(A×a)) of the (B×b) to the (A×a) is 1.80 or more.

The golf ball according to the present disclosure (3) is the golf ball according to the present disclosure (1) or (2), wherein a ratio (B/A) of the impulse difference "B" to the impulse difference "A" is 1.60 or more.

The golf ball according to the present disclosure (4) is the golf ball according to any one of the present disclosures (1) to (3), wherein the average hardness "a" is 70 or less in Shore C hardness, and the average hardness b is 70 or more in Shore C hardness.

The golf ball according to the present disclosure (5) is the golf ball according to any one of the present disclosures (1) to (4), wherein a hardness difference (Hs−H11) between a surface hardness (Hs) of the spherical core and a hardness (H11) at a point of 11 mm from the center of the spherical core is 0 or more in Shore C hardness.

The golf ball according to the present disclosure (6) is the golf ball according to any one of the present disclosures (1) to (5), wherein a hardness difference (H9−Ho) between the hardness (H9) at the point of 9 mm from the center of the spherical core and a center hardness (Ho) of the spherical core is 5 or more in Shore C hardness.

The golf ball according to the present disclosure (7) is the golf ball according to any one of the present disclosures (1) to (6), wherein the inner core is spherical and has a diameter ranging from 14 mm to 28 mm, and the outer core has a thickness ranging from 6 mm to 13 mm.

This application is based on Japanese Patent application No. 2022-28072 filed on Feb. 25, 2022, the content of which is hereby incorporated by reference.

The invention claimed is:

1. A golf ball comprising a spherical core having an inner core and an outer core, and a cover positioned outside the spherical core, wherein A×a is 12,200 or less, and B×b is 20,400 or more, where "a" represents an average hardness (Shore C) of a hardness (H2.5) at a point of 2.5 mm from a center of the spherical core and a hardness (H5) at a point of 5 mm from the center of the spherical core, "b" represents an average hardness (Shore C) of a hardness (H7.5) at a point of 7.5 mm from the center of the spherical core and a hardness (H9) at a point of 9 mm from the center of the spherical core, "A" represents an impulse difference (kN·μs) between a back spin impulse and a top spin impulse measured using a contact force tester under a condition corresponding to a condition when the golf ball is hit with a driver, and "B" represents an impulse difference (kN·μs) between a back spin impulse and a top spin impulse measured using a contact force tester under a condition corresponding to a condition when the golf ball is hit with an 8-iron.

2. The golf ball according to claim 1, wherein a ratio ((B×b)/(A×a)) of the (B×b) to the (A×a) is 1.80 or more.

3. The golf ball according to claim 1, wherein a ratio (B/A) of the impulse difference "B" to the impulse difference "A" is 1.60 or more.

4. The golf ball according to claim 1, wherein the average hardness "a" is 70 or less in Shore C hardness, and the average hardness "b" is 70 or more in Shore C hardness.

5. The golf ball according to claim 1, wherein a hardness difference (Hs−H11) between a surface hardness (Hs) of the spherical core and a hardness (H11) at a point of 11 mm from the center of the spherical core is 0 or more in Shore C hardness.

6. The golf ball according to claim 1, wherein a hardness difference (H9−Ho) between the hardness (H9) at the point of 9 mm from the center of the spherical core and a center hardness (Ho) of the spherical core is 5 or more in Shore C hardness.

7. The golf ball according to claim 1, wherein the inner core is spherical and has a diameter ranging from 14 mm to 28 mm, and the outer core has a thickness ranging from 6 mm to 13 mm.

8. The golf ball according to claim 1, wherein the impulse difference "A" is 200 kN·μs or less.

9. The golf ball according to claim 1, wherein the impulse difference "B" is 230 kN·μs or more.

10. The golf ball according to claim 1, wherein a hardness difference ("b-a") between the average hardness "b" and the average hardness "a" ranges from 5 to 40 in Shore C hardness.

11. The golf ball according to claim 1, wherein the hardness (H2.5) at the point of 2.5 mm from the center of the spherical core is 55 or more and 70 or less in Shore C hardness.

12. The golf ball according to claim 1, wherein the hardness (H5) at the point of 5 mm from the center of the spherical core is 60 or more and 75 or less in Shore C hardness.

13. The golf ball according to claim 1, wherein the hardness (H7.5) at the point of 7.5 mm from the center of the spherical core is 65 or more and 90 or less in Shore C hardness.

14. The golf ball according to claim 1, wherein the hardness (H9) at the point of 9 mm from the center of the spherical core is 70 or more and 95 or less in Shore C hardness.

15. The golf ball according to claim 1, wherein a hardness (H11) at a point of 11 mm from the center of the spherical core is 65 or more and 95 or less in Shore C hardness.

16. The golf ball according to claim 1, wherein a hardness (H12.5) at a point of 12.5 mm from the center of the spherical core is 65 or more and 95 or less in Shore C hardness.

17. The golf ball according to claim 1, wherein a hardness (H15) at a point of 15 mm from the center of the spherical core is 65 or more and 95 or less in Shore C hardness.

18. The golf ball according to claim 1, wherein a hardness difference (Hs−Ho) between a surface hardness (Hs) and a center hardness (Ho) of the spherical core is more than 10 in Shore C hardness.

19. The golf ball according to claim 1, wherein the cover comprises at least two layers.

* * * * *